US009364850B1

(12) United States Patent
Anderson

(10) Patent No.: US 9,364,850 B1
(45) Date of Patent: Jun. 14, 2016

(54) ADJUSTABLE PAINT ROLLER STOPPER

(71) Applicant: Bret Glen Anderson, Clearwater, MN (US)

(72) Inventor: Bret Glen Anderson, Clearwater, MN (US)

( * ) Notice: Subject to any disclaimer, the term of this patent is extended or adjusted under 35 U.S.C. 154(b) by 0 days.

(21) Appl. No.: 14/700,588

(22) Filed: Apr. 30, 2015

Related U.S. Application Data

(60) Provisional application No. 61/986,583, filed on Apr. 30, 2014.

(51) Int. Cl.
*B05C 17/02* (2006.01)

(52) U.S. Cl.
CPC ..... *B05C 17/0245* (2013.01); *B05C 17/02* (2013.01); *B05C 17/021* (2013.01); *B05C 17/0225* (2013.01)

(58) Field of Classification Search
CPC .. B05C 17/02; B05C 17/021; B05C 17/0222; B05C 17/0225; B05C 17/0245
USPC ..... 15/230.11, 246, 248.2; 492/13, 19
See application file for complete search history.

(56) References Cited

U.S. PATENT DOCUMENTS

| | | | |
|---|---|---|---|
| 3,088,152 | A | 5/1963 | Lucas |
| 3,790,984 | A | 2/1974 | Spransy et al. |
| 5,463,789 | A | 11/1995 | Zilinski |
| 6,574,824 | B2 | 6/2003 | Burns et al. |
| 7,340,796 | B2 | 3/2008 | Pyles |
| 8,332,988 | B2 | 12/2012 | Sweeney et al. |
| 8,615,839 | B1 | 12/2013 | Sweeney et al. |
| 2003/0200617 | A1 | 10/2003 | Pyles |

*Primary Examiner* — Mark Spisich
(74) *Attorney, Agent, or Firm* — DuFault Law Firm, P.C.; Dustin R. DuFault

(57) ABSTRACT

An adjustable stop device for use with a paint roller frame to prevent unwanted contact of a paint roller cover with a surface adjacent to a surface being painted includes a clamp adapted to engage a horizontal support of the paint roller frame, and a support member attached to the clamp in a substantially orthogonal manner. A securing mechanism is fitted to the support member to releasably secure the support member to a vertical support of the paint roller frame in a first working position. The support member is released, and pivoted away, from the vertical support while in a second non-working position. An adjustable arm extending from the distal end of the support member prevents roller cover contact of the adjacent surface by engaging the same.

11 Claims, 4 Drawing Sheets

ADJUSTABLE PAINT ROLLER STOPPER

CROSS-REFERENCE TO RELATED APPLICATION

This application claims the benefit of U.S. Provisional Patent Application No. 61/986,583, filed Apr. 30, 2014, which is hereby incorporated herein by reference.

BACKGROUND OF INVENTION

The present invention relates to paint rollers. More particularly, the present invention relates to a device attachable to a paint roller frame that assists in preventing unwanted contact of a paint roller cover with a surface adjacent to a surface being painted.

Paint rollers, including paint roller frames and roller covers, are known in the art. Briefly, a typical paint roller includes a handle graspable by the user by which to paint surfaces. A shank extending from the handle will generally have a "C"-shaped frame with a lower horizontal support, a vertical support and an upper horizontal support. A cage rotatably attached to the upper horizontal support provides a means upon which a roller cover is disposed. In grasping the handle, the user is able to sop up paint from a tray, and then apply the paint to a generally flat surface in a rolling fashion.

Paint rollers are typically used in situations where this is a relatively large, generally flat surface to be painted, and the paint can be applied by the paint rollers in an effective and efficient manner. Such instances include, but are not limited to, the painting of flat interior walls or ceilings. However, as the roller itself is round, the actual surface upon which the paint is being applied is not necessarily directly beneath the outer radius of the roller. As such, a gap between adjacent adjoining surfaces oftentimes results when using paint rollers. To minimize this gap, painters will try to paint as close to the abutting adjacent surface as possible which, if not extremely careful, could result in the roller being positioned too far such that the roller cover comes into contact with the adjacent surface and the unintentional application of paint thereon. This is often problematic in situations where it is difficult to judge the remaining distance between the paint roller cover and the adjacent surface.

There exist examples in the art that have attempted to overcome this drawback of using paint rollers, including for example U.S. Pat. Nos. 8,332,988 and 8,615,839. However, shortcomings exist in such examples as the guides discussed therein need to be manually removed each time paint from the paint tray is applied to the paint roller cover.

There therefore exists in the art the need to provide a paint roller stopper device that is effective and convenient to use in order to prevent the misapplication of paint on surfaces adjacent to the surface being painted. The present invention overcomes the shortcomings of the prior to accomplish this.

BRIEF SUMMARY OF INVENTION

An adjustable paint roller stopper of the present invention generally includes a main support leg having a proximal end and a distal end. Extending from the distal end of the main support leg is an adjustable arm having at its terminal end a rubber stopper. To accommodate roller covers of differing sizes, or to set the distance upon which the paint roller is stopped relative to the surface immediately adjacent a surface being painted, the length of the arm extending from the main support leg can be selectively increased or decreased. Extending substantially orthogonal from the proximal end of the main support leg is a secondary support leg having a snap clamp configured to be disposed upon the lower horizontal support of the paint roller frame to pivotally attach the paint roller stopper thereto. A securing mechanism configured to the main support leg permits releasable attachment of the main support leg to the vertical support of the paint roller frame. Disposed upon, and extending from, the proximal end of the main support leg is a thumb tab to manipulate the main support leg into engagement or disengagement from the vertical support of the paint roller frame.

In operation, the paint roller stopper is positioned to align the snap clamp of the secondary leg support with the lower horizontal support of the paint roller frame. The secondary leg support is then snapped into place onto the lower horizontal support of the paint roller frame, wherein the paint roller stopper is allowed to pivot about the lower horizontal support. With the paint roller stopper in the second non-working position, the paint roller is positioned by the user into a paint tray so that the paint roller cover is allowed to sop up paint. With the paint roller removed from the paint tray, the paint roller stopper is then manipulated by the user to pivot the main support leg into contact with the vertical support of the paint roller frame, whereby the first working position is achieved. The user then applies paint to a surface, and while applying the paint in a rolling fashion in close proximity to adjacent surfaces, the paint roller stopper comes into contact with an immediately adjacent surface, thereby preventing any further forward motion of the paint roller, and in turn preventing the paint roller cover from coming into contact with the adjacent surface.

DESCRIPTION OF INVENTION

Figure 2:
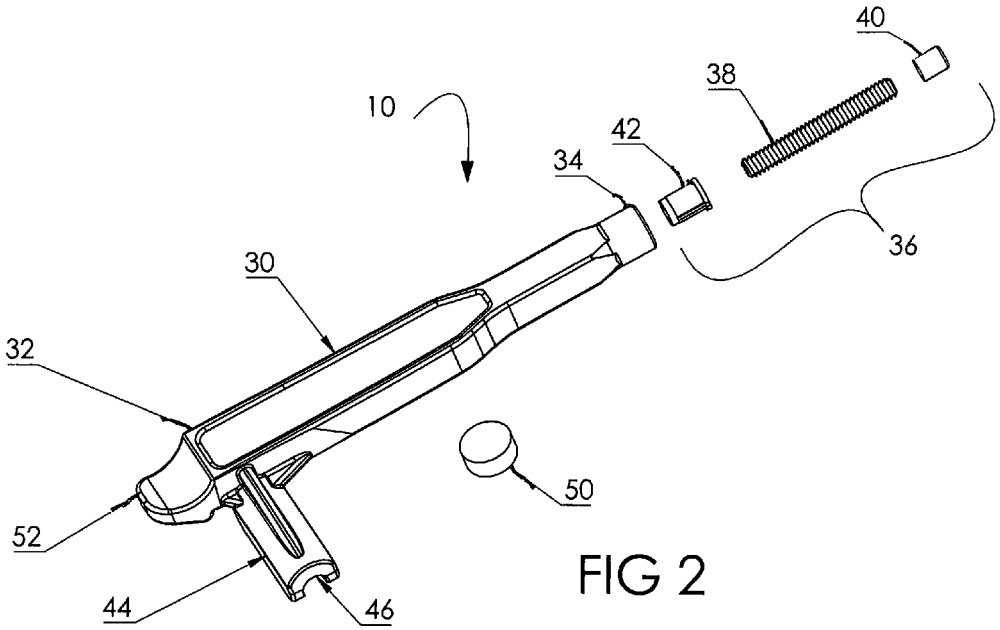
FIG. 2 is an exploded perspective view of the paint roller stopper in accordance with the present invention.
Figure 1:
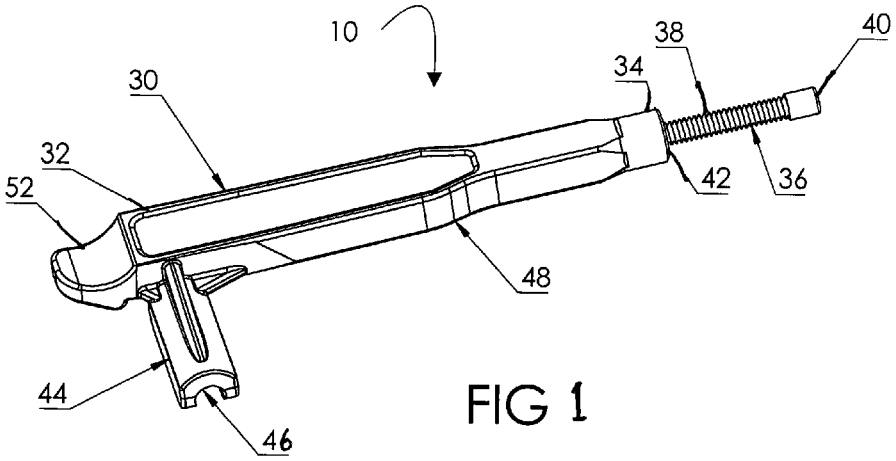
FIG. 1 is a perspective view of a paint roller stopper in accordance with the present invention.

A paint roller stopper of the present invention is generally indicated at 10 in FIGS. 1 and 2. As illustrated FIGS. 3 and 4, the paint roller stopper 10 of the present invention is configured to be attached to a paint roller 12, the likes of which is known in the art. Generally speaking, a typical paint roller 12 includes a handle 14 which is graspable by the user by which to paint surfaces. A shank 16 extending from the handle 14 will generally have a "C"-shaped frame 18 with a lower horizontal support 20, a vertical support 22 and an upper horizontal support 24. A cage 26 rotatably attached to the upper horizontal support 24 provides a means upon which a roller cover 28 is disposed. In grasping the handle 14, the user is able to sop up paint from a tray (not shown), and then apply the paint to a generally flat surface, such as a wall, in a back-and-forth rolling fashion, as is generally known in the art.

Referring back again to FIGS. 1 and 2, the paint roller stopper 10 of the present invention generally includes a main support leg 30 having a proximal end 32 and a distal end 34. Extending from the distal end 34 of the main support leg 30 is an adjustable arm 36. The extensible arm 36 preferably includes a threaded rod 38 having at its terminal end a rubber stopper 40. The opposing end of the threaded rod 38 threadably engages within a female threaded member 42 disposed within the distal end 34 of the main support leg 30. To accommodate roller covers 28 of differing sizes, or to set the distance upon which the paint roller 12 is stopped relative to the surface immediately adjacent a surface being painted, the threaded rod 38 can be rotated clockwise or counterclockwise to increase or decrease the length of the arm 36 and position the rubber stopper 40 relative to the distal end 34 of the main support leg 30. Alternatively, while the adjustable arm as shown is threaded, those skilled in the art will readily recognize that it is well within the scope of the present invention to include other variations of an extensible arm, including but not limited to, a slidable rod and locking mechanism to selectively adjust the length of the arm.

Extending substantially orthogonal from the proximal end 32 of the main support leg 30 is a secondary support leg 44 having a snap clamp 46. By substantially orthogonal it is meant that the angular relation between main support leg 30 and the secondary support leg 44 is preferably 90 degrees, but can be offset from perpendicular by up to 45 degrees to accommodate paint roller frames 18 that are not substantially "C"-shaped, as are known in the art. Preferably, the secondary support leg 44 is configured to house the snap clamp 46, as is illustrated in FIGS. 1 and 2. However, those skilled in the art will readily recognize that it is well within the scope of the present invention to alternatively attach a snap clamp to an outer surface of the secondary support leg. The snap clamp 46 itself is configured to be disposable upon the lower horizontal support 20 of the paint roller frame 18 to pivotally attach the paint roller stopper 10 thereto.

Figure 4:
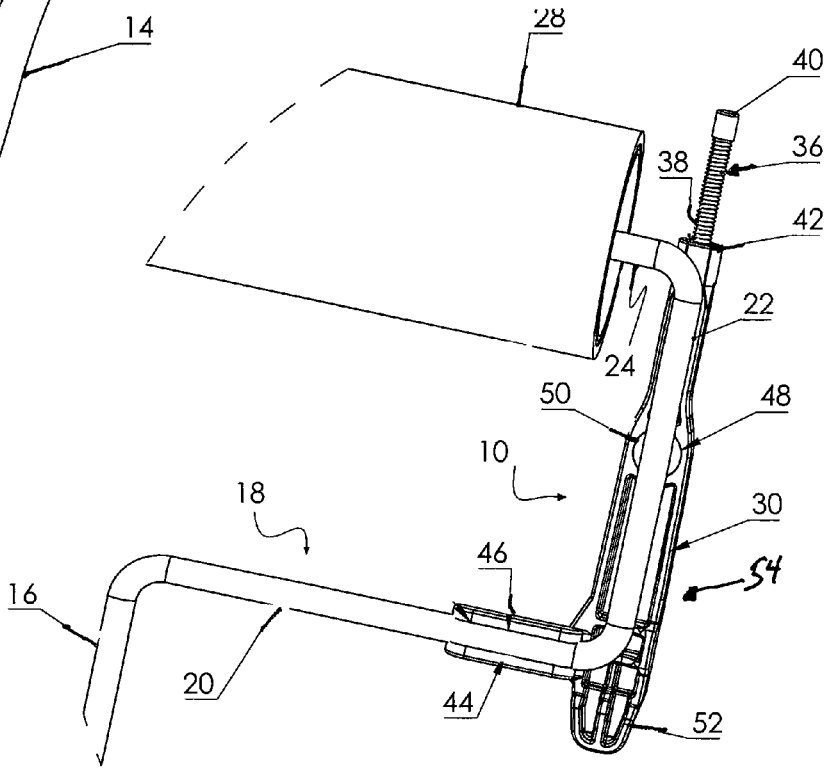
FIG. 4 is a back perspective view of the paint roller stopper of the present invention attached to a paint roller frame in the first working position.
Figure 5:
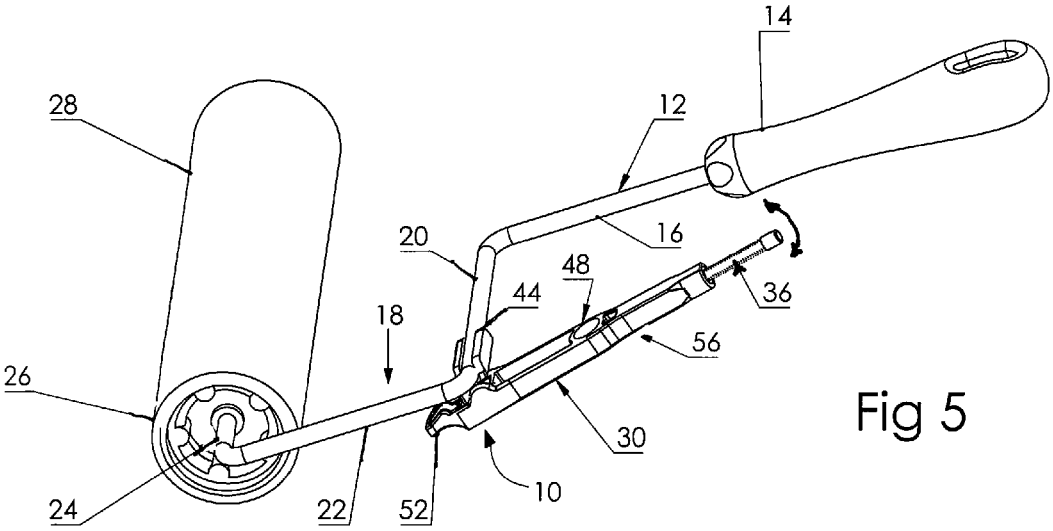
FIG. 5 is a perspective view of the paint roller stopper of the present invention attached to a paint roller frame in a second non-working position.

The paint roller stopper 10 of the present invention further includes a securing mechanism 48 configured to the main support leg 30. The purpose of the securing mechanism 48 is to permit releasable attachment of the main support leg 30 to the vertical support 22 of the paint roller frame 18. Preferably, and as illustrated in FIGS. 2, 4 and 5, the securing mechanism 48 includes a magnet 50 disposed with the main support leg 30 such that when the main support leg 30 is brought into contact with the vertical support 22 of the paint roller frame 18, the frame 18 itself being constructed of a metal, the main support leg 30 is held in place by magnetic attraction forces supplied by the magnet 50. However, those skilled in the art will readily recognize that it is well within the scope of the present invention to provide alternative means for the securing mechanism, including a second snap clamp attached the main support leg, the second snap clamp configured to receive the vertical support of the paint roller frame.

Disposed upon, and extending from, the proximal end 32 of the main support leg 30 is a thumb tab 52. The purpose of the thumb tab 52 is to provide a surface upon which a user's thumb, or any other digit of the user's hand, can be placed to manipulate and pivot the paint roller stopper 10 about the lower horizontal support 20 of the paint roller frame 18 to leverage and position the main support leg 30 into engagement or disengagement from the vertical support 22 of the paint roller frame 18.

Figure 3:
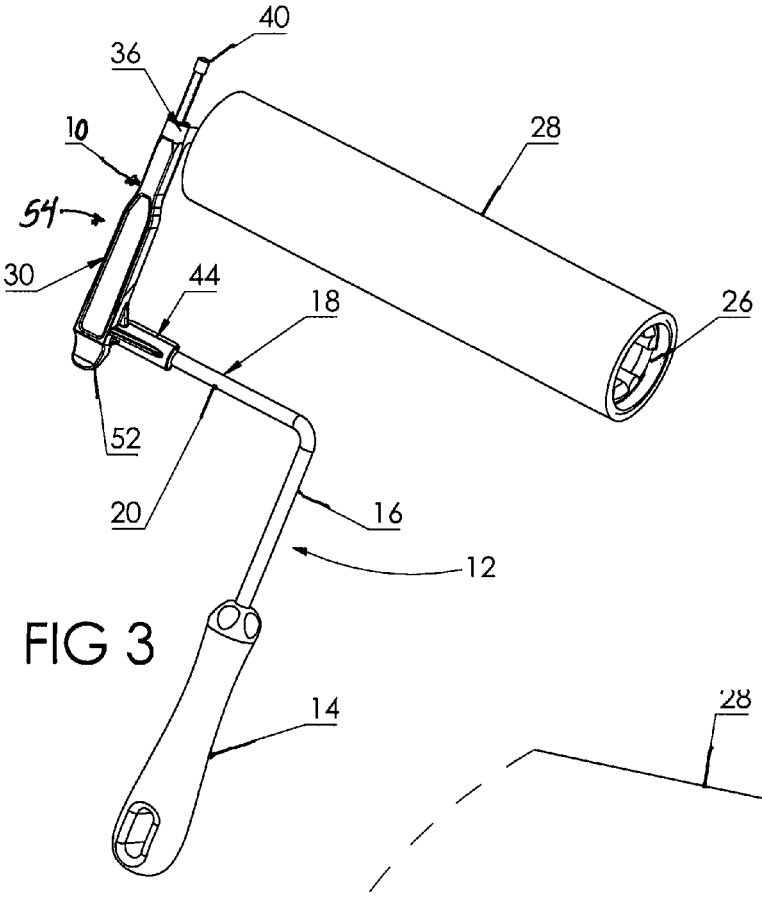
FIG. 3 is frontal perspective view of the paint roller stopper of the present invention attached to a paint roller frame in a first working position.
Figure 6:
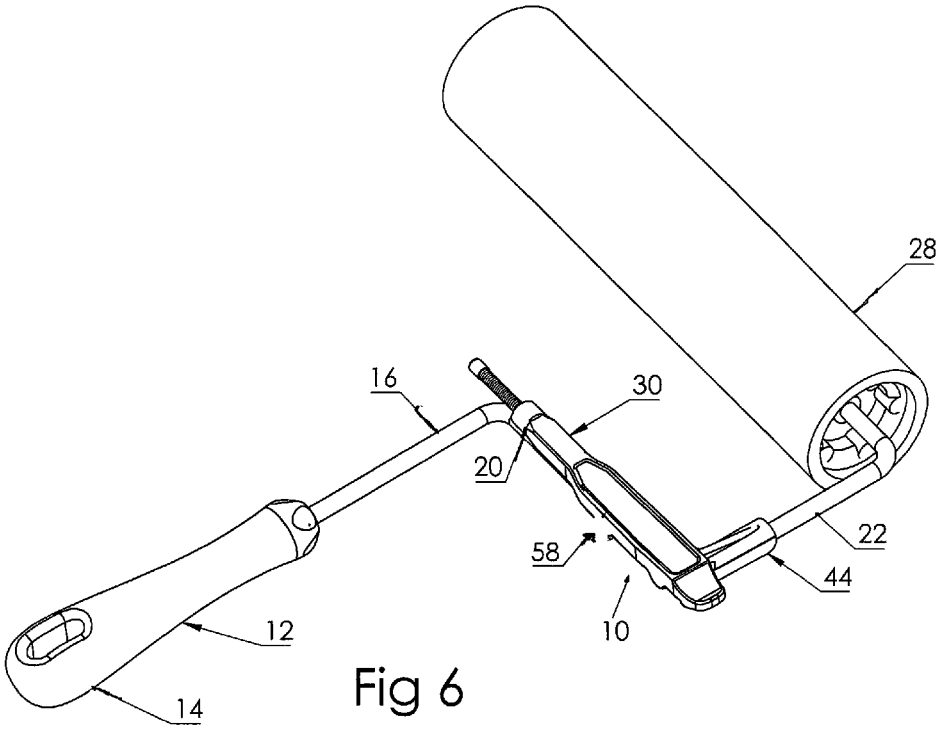
FIG. 6 is a perspective view of the paint roller stopper of the present invention attached to a paint roller frame in a third storage position.

FIGS. 3 and 4 illustrate the paint roller stopper 10 positioned in a first working position 54, with the secondary support leg 44 clamped to the lower horizontal support 20 of the paint roller frame 18 and the main support leg 30 being secured to the vertical support 22 of the paint roller frame 18 by the securing mechanism 48. FIG. 5 illustrates the paint roller stopper 10 positioned in a second non-working position 56, with the secondary support leg 44 clamped to the lower horizontal support 20 of the paint roller frame 18 and the main support leg 30 being disengaged from the vertical support 22 of the paint roller frame 18. FIG. 6 illustrates the paint roller stopper 10 positioned in a third storage position 58, with the secondary support leg 44 clamped to the vertical support 22 of the paint roller frame 18 and the main support leg 30 being secured to the lower horizontal support 20 of the paint roller frame 18 by the securing mechanism 48.

Figure 7:
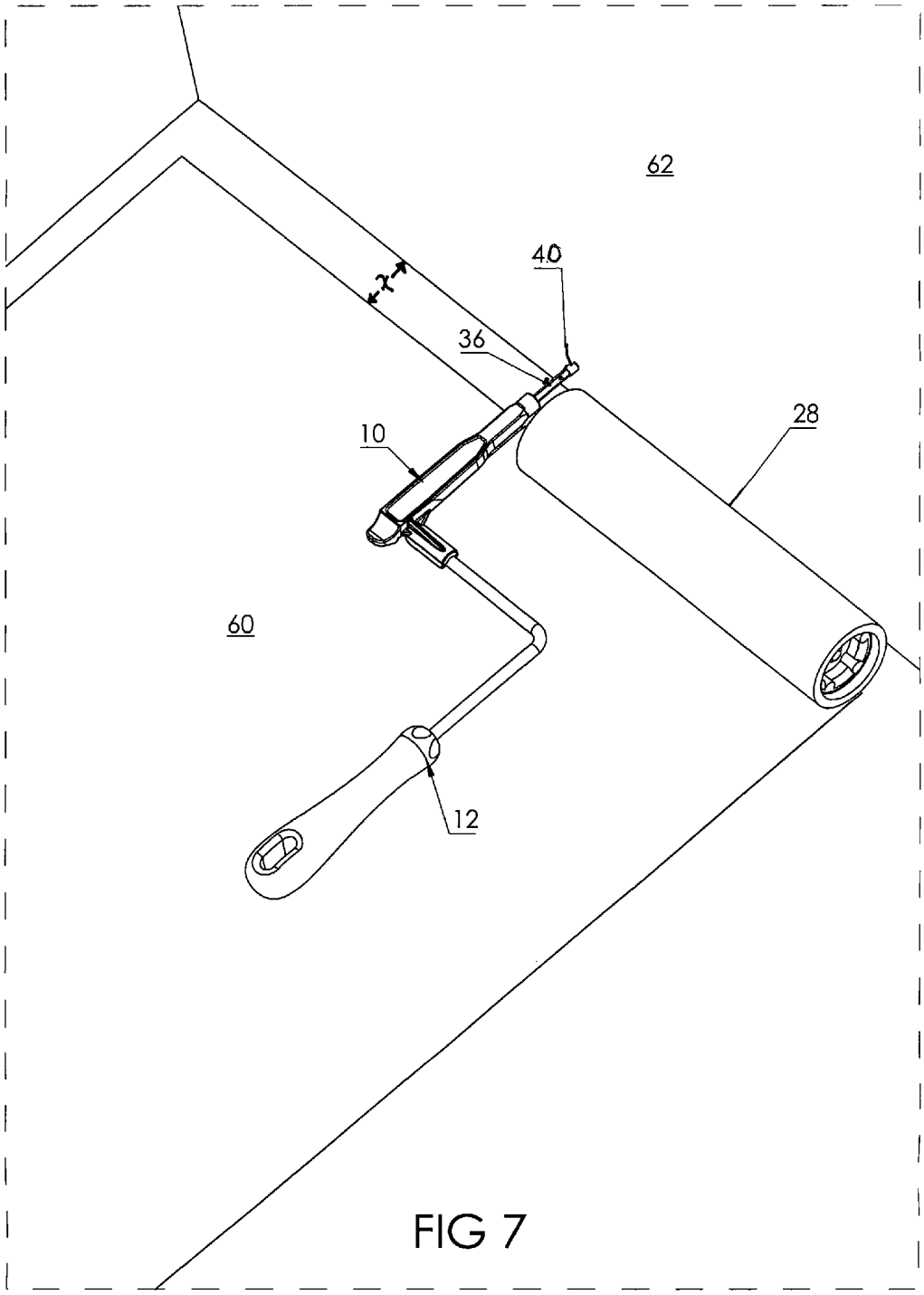
FIG. 7 is a perspective view of the paint roller of the present invention engaging an adjacent surface to prevent a paint roller from coming into contact with the same.

In operation, the paint roller stopper 10 of the present invention is positioned to align the snap clamp 46 of the secondary leg support 44 with the lower horizontal support 20 of the paint roller frame 18. The secondary leg support 44 is then snapped into place onto the lower horizontal support 20 of the paint roller frame 18, wherein the paint roller stopper 10 is allowed to pivot about the lower horizontal support 20. With the paint roller stopper 10 in the second non-working position 56, as illustrated in FIG. 5, and with the paint roller cover 28 in place, the paint roller 12 is positioned by the user into a paint tray so that the paint roller cover 28 is allowed to sop up paint. With the paint roller 12 removed from the paint tray, the paint roller stopper 10 is manipulated by the user to pivot the main support leg 30 into contact with the vertical support 22 of the paint roller frame 18, whereby the first working position 54 is achieved, as is illustrated in FIGS. 3 and 4. Upon bringing the main support member 30 into the first working position 54, the securing mechanism 48, preferably including a magnet 50, secures the main support member 30 to the vertical support 22 in the first working position 54. If not previously having done so, the adjustable arm 36 can be manipulated by the user to a proper length, preferably such that the stopper 40 extends past the roller cover 28. The user then applies paint to a surface 60, and while applying the paint in a rolling fashion in close proximity to adjacent surfaces, the paint rubber stopper 40 comes into contact with an immediately adjacent surface 62, thereby preventing any further forward motion of the paint roller 12, and in turn preventing the paint roller cover 28 from coming into contact with the adjacent surface 62, as is illustrated in FIG. 7. This will provide a non-painted area x between the surface being painted 60 and the immediately adjacent surface 62.

To reapply paint to the paint roller cover 28, the user manipulates the thumb tab 52 to overcome the magnetic force between the magnet 50 and vertical support 22 of the paint roller frame 18 and disengage the main support member 30 from the vertical support 22. The main support leg 30 is pivoted away from the vertical support 22 to the second non-working position 56, as illustrated in FIG. 5, such that the adjustable arm 36 will not be in the way when placing the paint roller cover 28 into the paint tray to sop up additional paint. When a sufficient amount of paint has been sopped up onto the paint roller cover 28, the steps as detailed herein are repeated.

For cleanup, or when the paint roller 12 is not in use, the paint roller stopper 10 can be conveniently stored in an unobtrusive manner by positioning the main support leg 30 into the second non-working position 56 as previously described, after which the secondary support leg 44 is manipulated by the user to overcome the force of the snap clamp 46, thereby removing the paint roller stopper 10 from the paint roller frame 18. The paint roller stopper 10 can then be placed into the third storage position 58 by positioning the secondary support leg 44 and snap clamp 46 over the vertical support 22 of the paint roller frame 18 while at the same time positioning the main support 30 and securing mechanism 48 into contact with the lower horizontal support 20 of the paint roller frame 18. This can also be done in situations where there is no need for using the paint roller stopper 10, such as when painting large surfaces areas wherein contact of the paint roller cover 28 with adjacent surfaces areas in not likely.

Although the present invention has been described with reference to preferred embodiments, workers skilled in the art will recognize that changes may be made in form and detail without departing from the spirit and scope of the invention.

The invention claimed is:

1. A stop device for use with a paint roller frame to prevent unwanted contact of a paint roller with a surface adjacent to a surface being painted, the stop device comprising:

a major leg having proximal and distal ends;

a minor leg extending substantially orthogonal from the proximal end of the major leg;

an adjustable arm extending from the distal end of the major leg;

a clamp fitted to the minor leg to pivotally secure the minor leg to a horizontal support of the paint roller frame; and a securing mechanism fitted to the major leg to releasably secure the major leg to a vertical support of the paint roller frame, wherein the stop device attaches to the paint roller frame by positioning the minor leg to engage the clamp with the horizontal support, wherein the major leg is pivotally positionable about the horizontal support between a first position and a second position, wherein the major leg is secured to the vertical support while in the first position, wherein the major leg is unsecured to the vertical support while in the second position.

2. The stop device of claim 1 wherein the securing mechanism includes a magnet.

3. The stop device of claim 1 further comprising a thumb tab extending from the proximal end of the major leg, the thumb tab for manipulating the stop device between the first position and the second position.

4. The stop device of claim 1 and further comprising a third storage position, the third storage position including the major leg secured to the horizontal support with the minor leg clamped to the vertical support.

5. A stop device for use with a paint roller frame to prevent unwanted contact of a paint roller with a surface adjacent to a surface being painted, the stop device comprising:

a clamp adapted to engage a horizontal support of the paint roller frame;

a support member having proximal and distal ends, the proximal end attached to the clamp in a substantially orthogonal manner, the support member positionable about the horizontal support between a first working position and a second non-working position;

an adjustable arm extending from the distal end of the support member; and a securing mechanism fitted to the support member to releasably secure the support member to a vertical support of the paint roller frame, wherein the support member secures to the vertical support with the clamp engaged to the horizontal support while in the first working position, wherein the support member is unsecured to the vertical support with the clamp engaged to the horizontal support while in the second position.

6. The stop device of claim 5 further comprising a thumb tab extending from the proximal end of the support member, the thumb tab for manipulating the stop device between the first working position and the second non-working position.

7. The stop device of claim 5 wherein the securing mechanism includes a magnet.

8. The stop device of claim 5 and further comprising a third storage position, the third storage position including the support member secured to the horizontal support with the clamp secured to the vertical support.

9. A stop device for use with a paint roller frame to prevent unwanted contact of a paint roller with a surface adjacent to a surface being painted, the stop device comprising:

a clamp adapted to engage a horizontal support of the paint roller frame;

a support member having proximal and distal ends, the proximal end attached to the clamp in a substantially orthogonal manner, the support member pivotally positionable about the horizontal support between a first working position and a second non-working position;

an adjustable arm extending from the distal end of the support member; and a magnet fitted to the support member to releasably secure the support member to a vertical support of the paint roller frame, wherein the support member secures to the vertical support with the clamp engaged to the horizontal support while in the first working position, wherein the support member is unsecured to the vertical support with the clamp engaged to the horizontal support while in the second position.

10. The stop device of claim 9 further comprising a thumb tab extending from the proximal end of the support member, the thumb tab for manipulating the stop device between the first working position and the second non-working position.

11. The stop device of claim 9 and further comprising a third storage position, the third storage position including the support member secured to the horizontal support with the clamp secured to the vertical support.

* * * * *